US011587523B2

(12) United States Patent
Mochizuki

(10) Patent No.: US 11,587,523 B2
(45) Date of Patent: Feb. 21, 2023

(54) ELECTRO-OPTICAL PANEL CONTROLLING DRIVING SEQUENCES IN DEMULTIPLEX DRIVING

(71) Applicant: SEIKO EPSON CORPORATION, Tokyo (JP)

(72) Inventor: Kota Mochizuki, Chino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/535,785

(22) Filed: Nov. 26, 2021

(65) Prior Publication Data

US 2022/0172691 A1 Jun. 2, 2022

(30) Foreign Application Priority Data

Nov. 27, 2020 (JP) ..... JP2020-196630

(51) Int. Cl.
*G09G 3/36* (2006.01)
*G09G 3/32* (2016.01)

(52) U.S. Cl.
CPC ..... *G09G 3/3688* (2013.01); *G09G 3/32* (2013.01); *G09G 2300/0408* (2013.01); *G09G 2310/0275* (2013.01); *G09G 2310/0297* (2013.01)

(58) Field of Classification Search
CPC ..... G09G 3/36; G09G 3/3611; G09G 3/3614; G09G 3/3622; G09G 3/3625; G09G 3/3674; G09G 3/3677; G09G 3/3681; G09G 3/3685; G09G 3/3688; G09G 3/3692; G09G 3/3696; G09G 2310/0297
USPC ..... 345/87–104
See application file for complete search history.

(56) References Cited

U.S. PATENT DOCUMENTS

2004/0013427 A1 1/2004 Ito
2005/0206969 A1* 9/2005 Murade ..... G09G 3/3688 358/497
2006/0274570 A1* 12/2006 Jeoung ..... G09G 3/3685 365/154
2010/0053145 A1* 3/2010 Morita ..... G09G 3/3688 345/213
2012/0169690 A1* 7/2012 Sasaki ..... G09G 3/3607 345/98
2014/0340297 A1 11/2014 Oke et al.
(Continued)

FOREIGN PATENT DOCUMENTS

JP 2004-086155 A 3/2004
JP 2007-178525 A 7/2007
JP 2013-167772 A 8/2013

*Primary Examiner* — Alexander Eisen
*Assistant Examiner* — Nelson Lam
(74) *Attorney, Agent, or Firm* — Oliff PLC

(57) ABSTRACT

A circuit device includes: a selection signal output circuit configured to output a selection signal based on first to fourth driving sequences in demultiplex driving, and a data line driving circuit configured to output first to fourth data signals to a data signal supply line in order of the first to fourth driving sequences. In the first driving sequence, the selection signal output circuit activates an i-th selection signal, and the data line driving circuit outputs an i-th data signal to an i-th data line. At this stage of operation, after the first to fourth driving sequences, a rewriting operation in which the selection signal output circuit activates the i-th selection signal, and the data line driving circuit outputs the i-th data signal to the i-th data line is performed.

7 Claims, 13 Drawing Sheets

(56) References Cited

U.S. PATENT DOCUMENTS

| | | | | |
|---|---|---|---|---|
| 2015/0356940 | A1* | 12/2015 | Yamaguchi | G02F 1/13454 345/92 |
| 2016/0118002 | A1* | 4/2016 | Ito | G09G 3/3614 345/96 |
| 2016/0125820 | A1* | 5/2016 | Ito | G09G 3/3685 345/99 |
| 2016/0140923 | A1* | 5/2016 | Tanaka | G09G 3/3655 345/212 |
| 2018/0090085 | A1* | 3/2018 | Enami | G09G 3/3655 |
| 2018/0158431 | A1* | 6/2018 | Fujikawa | G09G 3/3696 |
| 2020/0160807 | A1* | 5/2020 | Tomie | G09G 3/3677 |

* cited by examiner

| PERIOD | GS1 | GS2 | GS3 | GS4 | GS5 |
|---|---|---|---|---|---|
| COUNT VALUE | 00 | 01 | 10 | 11 | 00 |
| SELECTION SIGNAL | SEL1 | SEL2 | SEL3 | SEL4 | SEL1 |

| PERIOD | GS1 | GS2 | GS3 | GS4 | GS5 |
|---|---|---|---|---|---|
| COUNT VALUE | 00 | 01 | 10 | 11 | 00 |
| SELECTION SIGNAL | SEL3 | SEL4 | SEL1 | SEL2 | SEL3 |

FIG. 9

ELECTRO-OPTICAL PANEL CONTROLLING DRIVING SEQUENCES IN DEMULTIPLEX DRIVING

The present application is based on, and claims priority from JP Application Serial Number 2020-196630, filed Nov. 27, 2020, the disclosure of which is hereby incorporated by reference herein in its entirety.

BACKGROUND

1. Technical Field

The present disclosure relates to a circuit device, an electro-optical device, and the like.

2. Related Art

A demultiplex driving has been known as a driving method for an electro-optical device. When the number of data lines driven by demultiplex driving is set as X, a demultiplexer constituted of X pieces of switches is provided between a data signal supply line and the X pieces of data lines. The electro-optical device is configured to pre-charge the X pieces of data lines by firstly turning on all of the X pieces of switches and, at the same time, by outputting a precharge voltage to the data signal supply line. Next, the electro-optical device turns on the X pieces of switches one by one to select the X pieces of data lines one by one, and outputs data signals corresponding to pixels on each data line to the data signal supply line to write the data signals in the pixels on each data line.

JP-A-2007-178525 discloses a known technology for demultiplex driving. The electro-optical device disclosed in JP-A-2007-178525 is configured to select a data line that is selected first in a horizontal scanning period two times in a row in selecting the X pieces of data lines one by one, and to write the same data signal in the data line twice thus preventing occurrence of insufficient writing in a pixel electrode in common inversion driving.

In the above-described demultiplex driving, when a first switch is turned on after pre-charging and a data signal is written in pixels on a first data line, the remaining X−1 pieces of switches are in an off state, and a pre-charge voltage is held on the X−1 pieces of data lines electrically connected to the X−1 pieces of switches respectively. At this stage of operation, a data signal is supplied to one ends of the X−1 pieces of switches and a pre-charge voltage is supplied to the other ends of the X−1 pieces of switches and hence, a data signal of the data signal supply line is adversely influenced by leakage current of the X−1 pieces of switches. The data signal is a data signal to be written in pixels on the first data line and hence, the data signal generates an error in voltage with respect to a target voltage. As the data lines are selected one by one, the number of switches generating the leakage is gradually decreased in order of X−1 pieces, X−2 pieces, . . . , and 1 piece. Accordingly, the data line that is firstly selected in the demultiplex driving is most adversely influenced by the leakage current. That is, the target voltage differs between the firstly selected data line and the lastly selected data line, and such there is a possibility that such a difference in target voltage is visually recognized as irregularities in an image.

It is thought that the larger the number of times of demultiplexing, the larger a writing error of a data signal caused by such a leakage current becomes. To overcome such a problem, it is conceivable to decrease the number of driving amplifiers for lowering the power consumption or to increase the number of times of demultiplexing for the purpose of increasing the number of pixels on an electro-optical panel. However, in such a method, there is a problem that the writing error caused by the leakage current becomes an obstacle in increasing the number of times of demultiplexing.

SUMMARY

According to an aspect of the present disclosure, there is provided a circuit device configured to drive an electro-optical panel including a switching circuit disposed between first to n-th data lines (n is an integer equal to or greater than 3) and a data signal supply line, wherein the circuit device includes: a selection signal output circuit configured to output first to n-th selection signals for controlling electrically connecting between the first to n-th data lines and the data signal supply line based on first to n-th driving sequences in demultiplex driving to the switching circuit, and a data line driving circuit configured to output first to n-th data signals corresponding to the first to n-th data lines to the data signal supply line in order of the first to n-th driving sequences, and, when, in the first driving sequence among the first to n-th driving sequences, the selection signal output circuit activates an i-th selection signal (i is an integer equal to or more than land equal to or less than n) among the first to n-th selection signals, and the data line driving circuit outputs an i-th data signal among the first to n-th data signals to an i-th data line among the first to n-th data lines, after the first to n-th driving sequences, a rewriting operation in which the selection signal output circuit activates the i-th selection signal, and the data line driving circuit outputs the i-th data signal to the i-th data line is performed.

According to another aspect of the present disclosure, there is provided an electro-optical device including the circuit device and the electro-optical panel described above.

BRIEF DESCRIPTION OF THE DRAWINGS

FIG. 9 is an operation example of a multiplexing circuit.

DESCRIPTION OF EXEMPLARY EMBODIMENTS

Hereinafter, a preferred embodiment of the present disclosure is described in detail. Here, the present embodiment described hereinafter is not intended to unjustly limit the content of the present disclosure as set forth in the claims, and all of the configurations described in the present embodiment are not always the essential constitutional elements.

1. Circuit Device, Electro-Optical Panel

Figure 1:
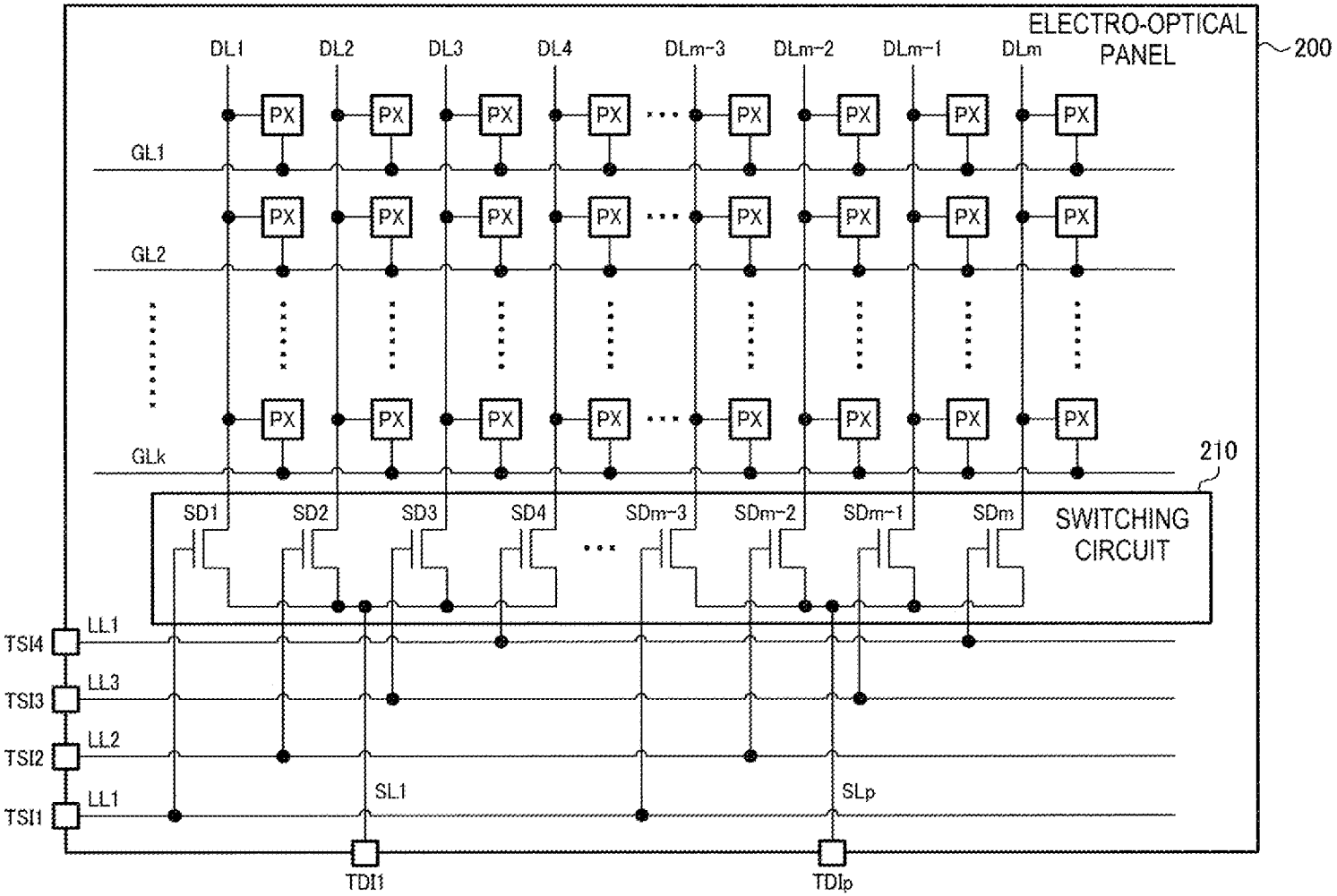
FIG. 1 is a circuit diagram illustrating a configuration example of an electro-optical panel.
Figure 2:
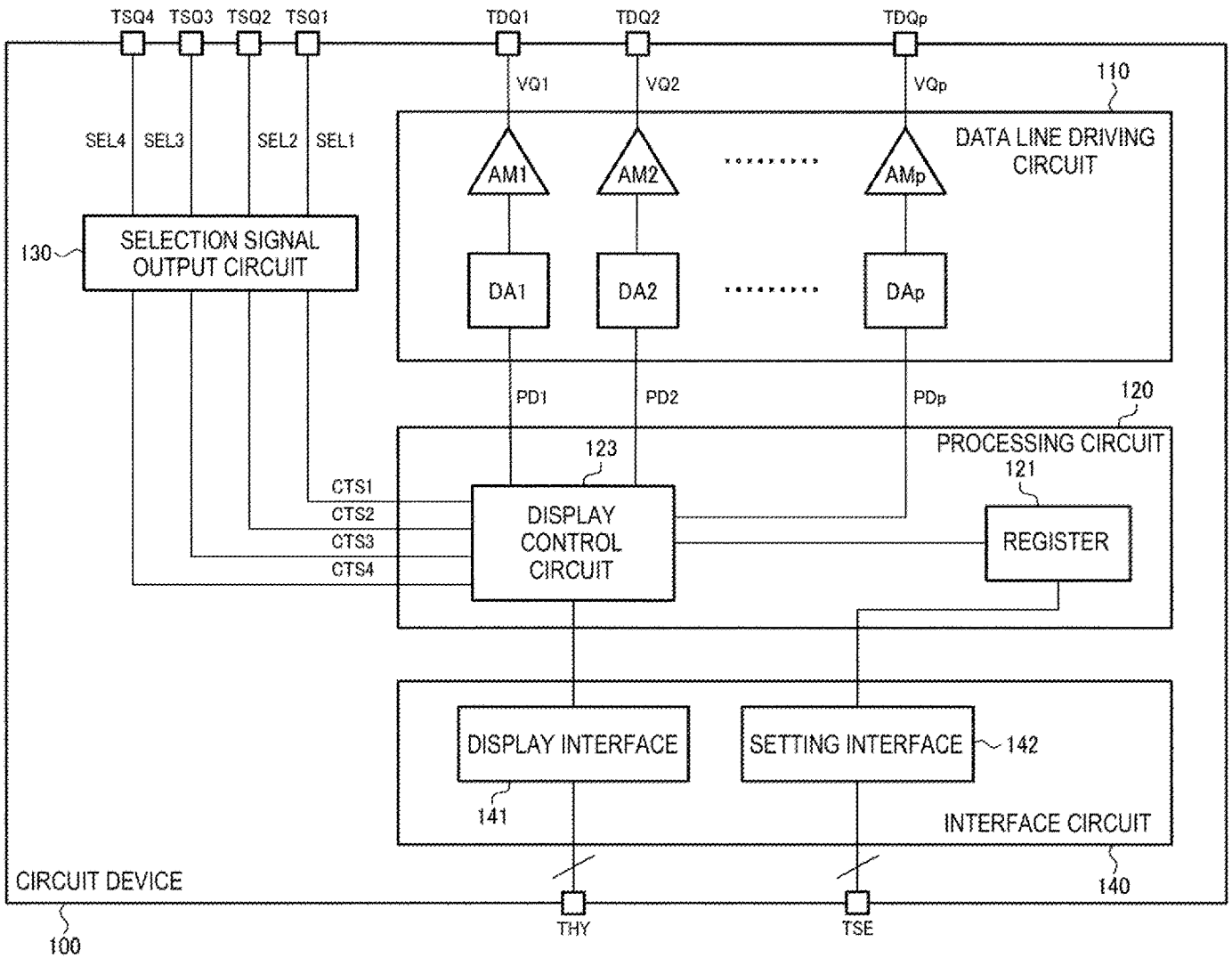
FIG. 2 is a circuit diagram illustrating a configuration example of a circuit device.

FIG. 1 illustrates a configuration example of an electro-optical panel 200 driven by a circuit device 100 according to the present embodiment, and FIG. 2 illustrates a configuration example of the circuit device 100 according to the present embodiment. Hereinafter, the number of demultiplexes is set to 4. However, when n is an integer equal to or greater than 3, the number of demultiplexes may be set to n.

First, the electro-optical panel 200 illustrated in FIG. 1 is described. The electro-optical panel 200 is an active matrix display panel driven by a demultiplex driving method, and is a liquid crystal display panel or an EL display panel, for example. "EL" is an abbreviation for Electro Luminescence. The electro-optical panel 200 includes data signal input terminals TDI1 to TDIp, data signal supply lines SL1 to SLp, select signal input terminals TSI1 to TSI4, select signal lines LL1 to LL4, a switch circuit 210, data lines DL1 to DLm, scanning signal lines GL1 to GLk, and a plurality of pixels PX. Symbol p is an integer equal to or greater than 2. Symbol m is an integer obtained by multiplying p by the number of demultiplexes. Symbol k is an integer equal to or greater than 2.

One end of the selection signal line LL1 is electrically connected to the selection signal input terminal TSI1. In the same manner, one ends of the selection signal lines LL2 to LL4 are electrically connected to the selection signal input terminals TSI2 to TSI4 respectively. One end of the data signal supply line SL1 is electrically connected to the data signal input terminal TDI1. In the same manner, one ends of the data signal supply lines SL2 to SLp are electrically connected to the data signal input terminals TDI2 to TDIp respectively.

The switch circuit 210 includes transistors SD1 to SDm. The transistors SD1 to SDm are each formed of an N-type transistor that is operated as a switch and is constituted of a thin film transistor (TFT), for example. One of sources and drains of the transistors SD1 to SD4 are electrically connected to the other end of the data signal supply line SL1 in common. The other of the source and the drain of the transistor SD1 is electrically connected to one end of the data line DL1. In the same manner, the other of the sources and the drains of the transistors SD2 to SD4 are electrically connected to one ends of the data lines DL2 to DL4 respectively. A gate of the transistor SD1 is electrically connected to the selection signal line LL1. In the same manner, gates of the transistors SD2 to SD4 are connected to the selection signal lines LL2 to LL4 respectively. Also with respect to the transistors SD5 to Sdm, configurations similar to the configurations of the transistors SD2 to SD4 are repeated.

The plurality of pixels PX are m×k pieces of pixels. To one pixel PX, one data line among the data lines DL1 to DLm and one scanning signal line among the scanning signal lines GL1 to GLk are electrically connected. Here, the electro-optical panel 200 may include a scanning driver, not illustrated in the drawing, that is configured to output a scanning signal to the scanning signal lines GL1 to GLk. Alternatively, the scanning driver may be provided to the circuit device 100.

Next, the circuit device 100 illustrated in FIG. 2 is described. The circuit device 100 is a display driver configured to drive the electro-optical panel 200, and is an integrated circuit device where a circuit element is formed on a substrate by a semiconductor process. The circuit device 100 includes a data line drive circuit 110, a processing circuit 120, a selection signal output circuit 130, an interface circuit 140, select signal output terminals TSQ1 to TSQ4, data signal output terminals TDQ1 to TDQp, and interface terminals THY, TSE. The respective terminals are each formed of a pad mounted on a substrate of the integrated circuit device or a terminal mounted on a package of the integrated circuit device. Here, in FIG. 2, although only one interface terminal THY and one interface terminal TSE are illustrated in an omitted manner, in an actual configuration, terminals the number of which corresponds to the number of input signals are provided respectively.

The interface circuit 140 enables the communication between an external processing device and the display device 10. The interface circuit 140 includes a display interface 141 and a settings interface 142.

As the display interface 141, various kinds of image interface is adopted such as an interface using a PGB interface system, an interface using a low voltage differential signal (LVDS) system, or the like. The display interface 141 is configured to receive display data and display control signals input via the interface terminal THY. The display control signals are clock signals, synchronization signals, or the like.

As the setting interface 142, various kinds of serial interface is adopted such as an interface using a serial peripheral interface (SPI) system, an interface using an inter integrated circuit (I2C) system, or the like. For example, when the interface using the SPI system is adopted as the setting interface 142, the settings interface 142 is configured to receive a chip select signal, a clock signal, and a serial data signal input via the interface terminal TSE.

The processing circuit 120 is configured to perform signal processing for image data, control of display timing, and operation setting processing for the circuit device 100. The processing circuit 120 includes a register 121 and a display control circuit 123. The processing circuit 120 is a logic circuit, and is a gate array constituted by automatic layout wiring, a standard cell array constituted by automatic wiring, or the like, for example. Here, a portion or all of the processing circuit 120 and the interface circuit 140, and a portion or all of the selection signal output circuit 130 may be constituted as an integrated gate array or an integrated standard cell array.

The display control circuit 123 is configured to control a display timing based on display data and display control signals received by the display interface 141. To be more specific, the display control circuit 123 is configured to control a timing of demultiplex driving by outputting selection control signals CTS1 to CTS4, and to output display data PD1 to PDp to the data line driving circuit 110 at a timing synchronized with the timing of controlling the demultiplex driving. In the present embodiment, the data line driving circuit 110 drives the data line driven in the first drive sequence in the demultiplex driving again after the n-th driving sequence. The display control circuit 123 is configured to control timing of such a rewriting operation. The rewriting operation is described in detail later.

In the register 121, operation setting data is written based on the signals received by the settings interface 142. The processing circuit 120 is configured to perform an operation setting of each part of the circuit device 100 based on the operation setting data stored in the register 121. For example, an enable signal ENB described later is written in the register 121 via the setting interface 142. The display control circuit 123 changes display timing based on the enable signal ENB stored in the register 121.

The data line driving circuit 110 is configured to drive the electro-optical panel 200 by supplying data signals to the pixels PX of the electro-optical panel 200. The data line driving circuit 110 includes D/A converter circuits DA1 to DAp and amplifier circuits AM1 to AMp. The D/A converter circuit DA1 is a circuit configured to perform D/A conversion of display data PD1, and is a switching circuit for selecting a reference voltage corresponding to the display data PD1 from among a plurality of reference voltages. In the same manner, the D/A converter circuits DA2 to DAp are circuits for performing D/A conversion of display data PD2 to PDp. The amplifier circuit AM1 is a circuit for outputting a data signal VQ1 to the data signal output terminal TDQ1 by amplifying or buffering an output voltage of the D/A converter circuit DA1. In the same manner, the amplifier circuits AM2 to AMp are circuits for amplifying or buffering output voltages of the D/A converter circuits DA2 to DAp. The amplifier circuits AM1 to AMp may each include an operational amplifier, a resistor, a capacitor, and the like. The data signal output terminals TDQ1 to TDQp are electrically connected to the data signal input terminals TDI1 to TDIp of the electro-optical panel 200 respectively.

The selection signal output circuit 130 is configured to output selection signals SEL1 to SEL4 to the selection signal output terminals TSQ1 to TSQ4 based on the selection control signals CTS1 to CTS4. The selection signals SEL1 to SEL4 are supplied for controlling the electrically connecting between the data lines and the data signal supply line. Taking the data signal supply line SL1 as an example, the selection signals SEL1 to SEL4 are supplied for controlling the electrically connecting between the data lines DL1 to DL4 and the data signal supply line SL1. The selection signal output terminals TSQ1 to TSQ4 are electrically connected to the selection signal input terminals TSI1 to TSI4 of the electro-optical panel 200 respectively.

2. Writing Error Caused by Leakage Current

A writing error caused by a leakage current in demultiplex driving in the related art is described with reference to FIG. 3 to FIG. 5. Here, the description is made by taking, as an example, a case where the data lines DL1 to DL4 illustrated in FIG. 1 are driven by demultiplex driving in that order without considering rotation. However, the similar writing error occurs also in a case where the rotation is performed.

Figure 3:
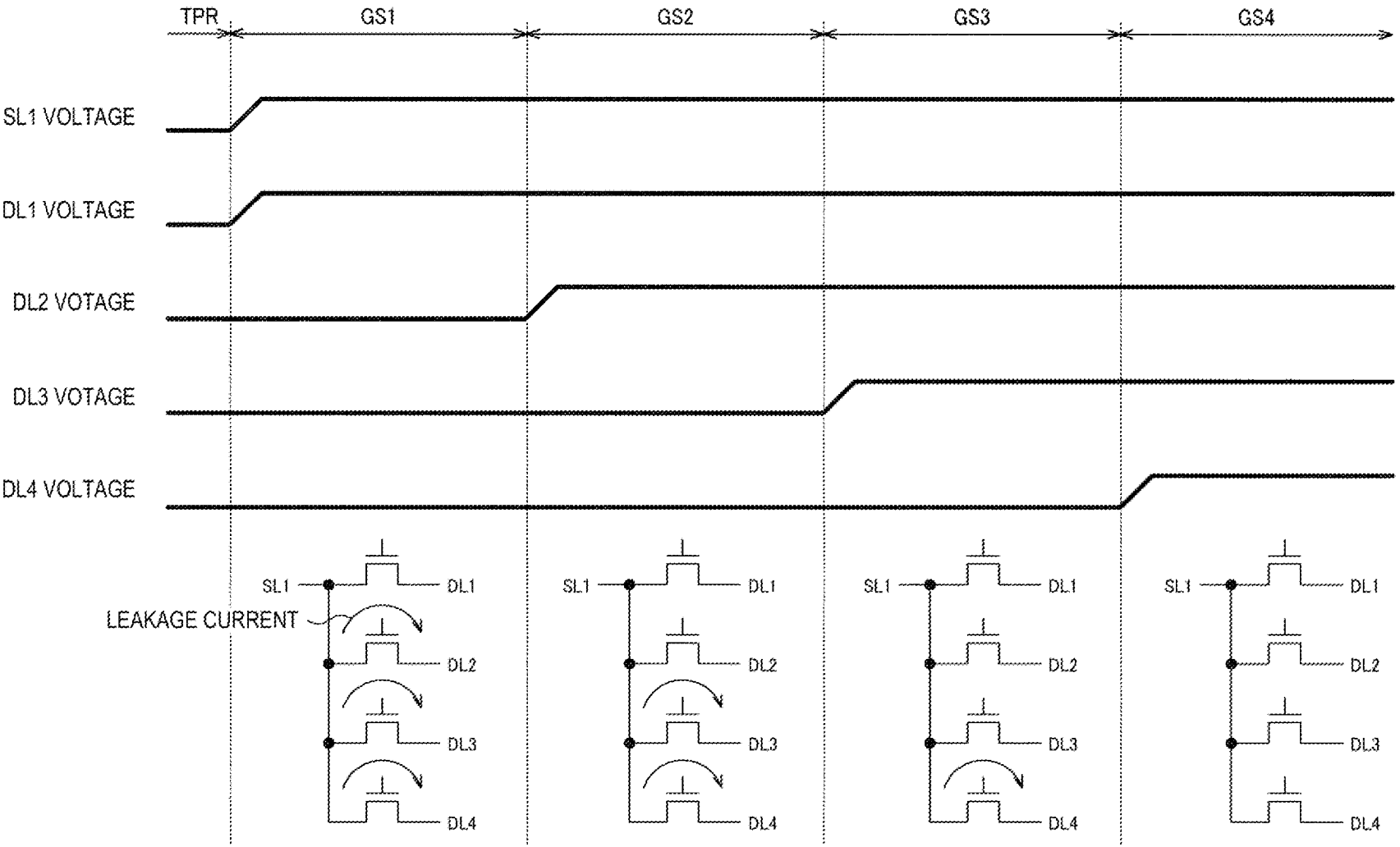
FIG. 3 is an explanatory view with respect to a writing error caused by a leakage current in demultiplex driving in a related art.

FIG. 3 illustrates voltage waveforms of the data signal supply line SL1 and the data lines DL1 to DL4 in one horizontal scanning period, and schematic diagrams of the leakage current flowing through the switches of the switching circuit 210, in the demultiplex driving according to the related art. Transistors illustrated in a lower side of FIG. 3 indicate the switches of the switching circuit 210 respectively.

In a pre-charge period TPR, the selection signal output circuit 130 outputs high-level selection signals SEL1 to SEL4, and the data line driving circuit 110 outputs a pre-charge voltage to the data signal supply line SL1. All of the switches of the switching circuit 210 are turned on and hence, a pre-charge voltage is applied to all of the data lines DL1 to DL4.

Assume that the demultiplex driving is performed for driving periods GS1 to GS4. In the driving period GS1, the selection signal output circuit 130 outputs the high-level selection signal SEL1 and low-level selection signals SEL2 to SEL4, and the data line driving circuit 110 outputs a data signal corresponding to the pixels on the data line DL1 to the data signal supply line SL1. The switch electrically connected to the data line DL1 is turned on and hence, the data signal is written in the pixels on the data line DL1. The data lines DL2 to DL4 remain at the pre-charge voltage.

In the present embodiment, the circuit device 100 is configured to perform polarity inversion driving. That is, the drive polarity is inverted for every one or a plurality of frames, or for every one or a plurality of scanning lines. The pre-charge voltage belongs to a negative-polarity gradation voltage range lower than the common voltage. In FIG. 3, waveforms of voltages in positive-polarity driving are illustrated. That is, the data signal belongs to a positive-polarity gradation voltage range higher than the common voltage. Here, in the driving period GS1, the voltage supplied to the data signal supply line SL1 is a positive-polarity data signal, and the voltage supplied to the data lines DL2 to DL4 is a negative-polarity pre-charge voltage. Accordingly, a leakage current flows from the data signal supply line SL1 to the data lines DL2 to DL4 via the switches.

In the driving periods GS2, GS3, and GS4, the switches are turned on one by one and hence, the number of data lines holding the pre-charge voltage is decreased one by one. Accordingly, the number of switches through which the leakage current flows in the driving periods GS2, GS3, and GS4 is reduced to two, one, and zero so that an amount of leakage current is also reduced. That is, an effect of the leakage current becomes maximum in the driving period GS1, and becomes minimum in the driving period GS4.

Figure 4:
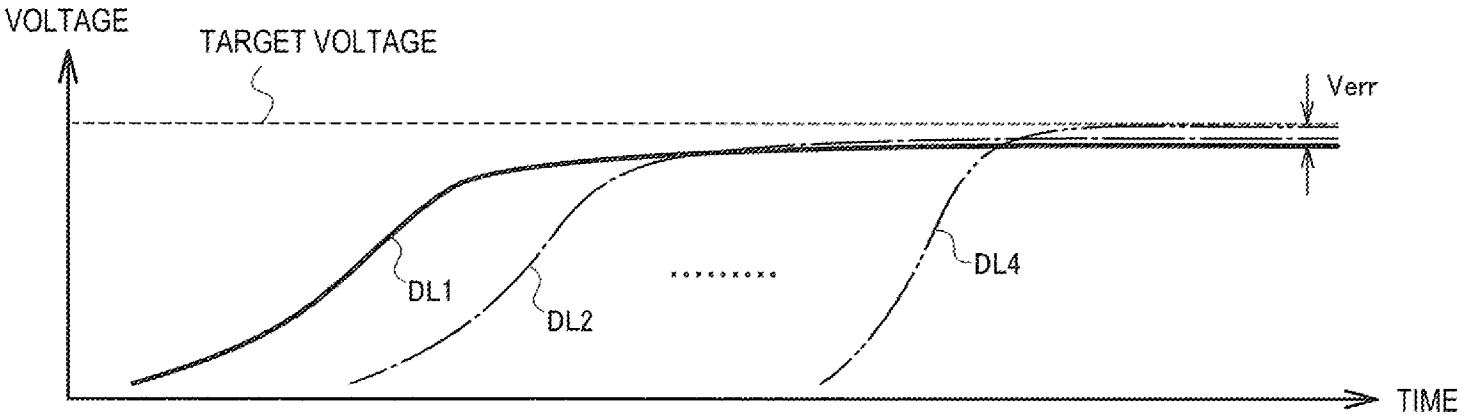
FIG. 4 is an explanatory view with respect to the writing error caused by the leakage current in the demultiplex driving in the related art.

In FIG. 4, simulation waveforms of voltages of the data lines DL1 to DL4 are illustrated.

In the electro-optical panel 200, there is provided an input resistance between the data signal input terminal TDI1 and the switching circuit 210. The leakage current flowing through the switch flows in the input resistance and hence, the voltage of the data signal supply line is lowered by voltage drop. Accordingly, the voltage written in each data line from the data signal supply line becomes a voltage lower than the target voltage of the data signal that the data line driving circuit 110 outputs by an amount of voltage drop.

As illustrated in FIG. 4, the data signals written in the data lines DL1 to DL3 are voltages lower than the target voltage. In FIG. 4, the writing error in the data line DL1 is expressed as Verr. The writing error becomes maximum at the data line DL1, and becomes smaller in the order of the data lines DL2 and DL3. In the data line DL4, the leakage current is substantially zero and hence, the writing error in the data line DL4 becomes substantially zero.

Figure 5:
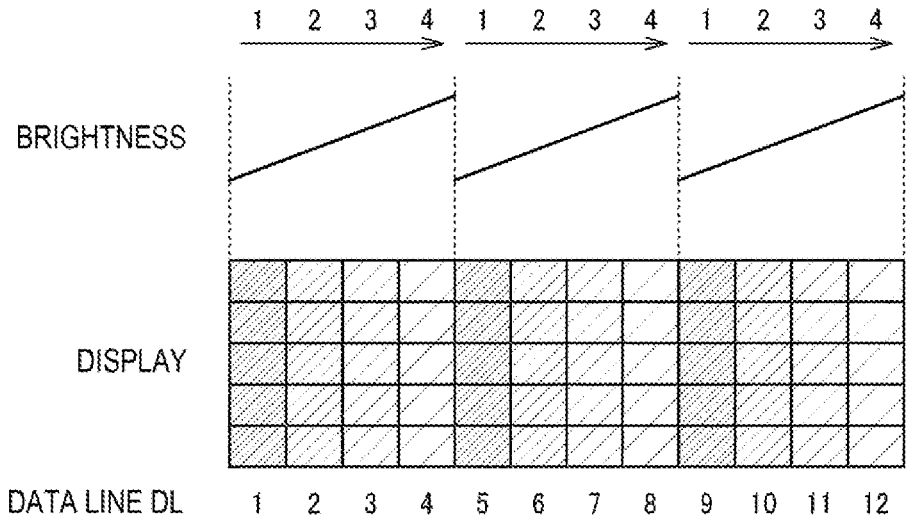
FIG. 5 is an explanatory view with respect to the writing error caused by the leakage current in the demultiplex driving in the related art.

FIG. 5 is a diagram illustrating a relationship between the writing error caused by the leakage current and a display. Numbers indicated with an arrow indicate the driving sequences in the demultiplex driving. That is, numbers "1" to "4" respectively correspond to the driving periods GS1 to GS4. "BRIGHTNESS" indicates the brightness of the pixel in which the data signal is written. "DISPLAY" schematically shows the manner how the pixels appear. One rectangle frame means one pixel, and the pixels with low brightness are shaded with dark hatching.

Here, it is assumed that data signals having the same target voltage are written in all of the pixels. That is, if there is no writing error, all of the pixels have the same brightness. However, due to the writing error described above, the brightness of the pixels is lowered in order of the driving sequences 4, 3, 2, and 1. The data line DL5 driven in the driving sequence 1 is arranged adjacent to the data line DL4 driven in the driving sequence 4 and hence, the difference in brightness between the data lines DL4 and DL5 is increased. That is, the difference in brightness increases at a boundary of blocks that are driven in the demultiplex driving. Further, since the difference in brightness is visually recognized as display irregularities, the display quality is lowered.

Hereinafter, a specific example of the degree of the writing error that is caused by the leakage current is described.

The writing error in the data line DL1 is expressed by $Verr=Rin\times(n-1)\times Ileak$, wherein Rin is an input resistance of the electro-optical panel 200, and Ileak is a leakage current per one switch. Here, n is set to 4 (n=4) and hence, $Verr=Rin\times3\times Ileak$ is established. However, the larger the number of times n of demultiplexing, the larger the writing error Verr becomes.

For example, the leakage current is mainly caused by leakage of light, and it is estimated that the leakage current Ileak becomes approximately 100 nA (Ileak=approximately 100 nA). Further, as the input resistance Rin of the electro-optical panel, an input resistance of approximately 2 kΩ is assumed (Rin=approximately 2 kΩ). When the number of times n of demultiplexing is set to 8 (n=8), the relationship of $Verr=2\ k\Omega\times(8-1)\times100\ nA=1.4\ mV$ is established. When the gradation voltage range of one polarity is set to 5 V and the number of gradations is set to the 12th power of 2, a voltage step ΔV per one gradation becomes approximately 1.2 mV (ΔV=approximately 1.2 mV). That is, the relationship of $Verr>\Delta V$ is established. For example, it is conceivable to decrease the number of driving amplifiers for lowering the power consumption or to increase the number of times n of demultiplexing for the purpose of increasing the number of pixels of the electro-optical panel. However, the more the number of times n of demultiplexing is increased, the larger the writing error Verr becomes, and the difference in brightness attributed to such a configuration is easily visually recognized. Further, there is a technique where the display irregularities are dispersed by performing rotation in the demultiplex driving thus lowering the visibility of the display irregularities. However, when the number of times n of demultiplexing is increased, a cycle of rotation is extended and, at the same time, the writing error also becomes large so that a possibility that the display irregularities are visually recognized is increased.

As described above, in the demultiplex driving according to the related art, the writing error of the data signal attributed to the leakage current decreases the display quality. Further, the writing error attributed to the leakage current becomes an obstacle in increasing the number of times of demultiplexing.

3. Driving Method of the Present Embodiment

Figure 6:
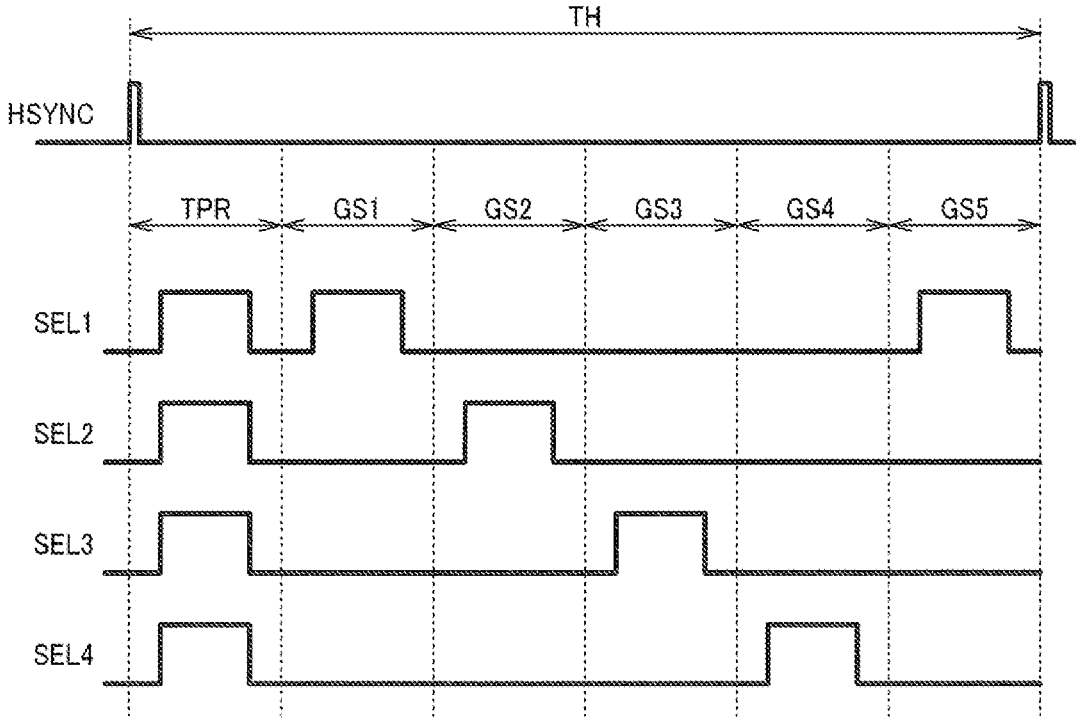
FIG. 6 is a waveform diagram illustrating a first driving method according to a present embodiment.

FIG. 6 is a waveform diagram illustrating a first driving method according to the present embodiment. Here, the description is made by taking a case where the number of times n of demultiplexing is set to 4 (n=4), and the rotation is not performed, as an example. Further, the description is made by taking an operation of a block of the data signal supply line SL1 and the data lines DL1 to DL4 as an example. However, substantially the same operation is performed also in other blocks.

As illustrated in FIG. 6, a period between a rising edge of the horizontal synchronization signal HSYNC and a next rising edge of the horizontal synchronization signal HSTNC is defined as a horizontal scanning period TH. The horizontal scanning period TH is divided into a pre-charge period TPR and driving periods GS1 to GS5. A length of the pre-charge period TPR and a length of one driving period may differ from each other.

During the pre-charge period TPR, the selection signal output circuit 130 outputs high-level selection signals SEL1 to SEL4, and the data line driving circuit 110 outputs a pre-charge voltage to the data signal supply line SL1. All of the switches of the switching circuit 210 are turned on and hence, the pre-charge voltage is applied to all of the data lines DL1 to DL4.

In the driving period GS1, the selection signal output circuit 130 outputs the high-level selection signal SEL1 and low-level selection signals SEL2 to SEL4, and the data line driving circuit 110 outputs a data signal corresponding to the pixels on the data line DL1 to the data signal supply line SL1. The switch electrically connected to the data line DL1 is turned on and hence, the data signal is written in the pixels on the data line DL1. In the same manner, in the driving periods GS2 to GS4, the selection signal output circuit 130 outputs high-level selection signals SEL2 to SEL4, and the data line driving circuit 110 outputs data signals corresponding to the pixels on the data lines DL2 to DL4 to the data signal supply line SL1. The switches electrically connected to the data lines DL2 to DL4 respectively are turned on and hence, the data signals are written in the pixels on the data lines DL2 to DL4.

The driving period GS5 corresponds to a driving period GSn+1 when the number of times n of demultiplexing is set to n. That is, in the present embodiment, n+1 pieces of driving periods are provided with respect to the number of times n of demultiplexing. In the driving period GS5, the selection signal output circuit 130 outputs the high-level selection signal SEL1 and the low-level selection signals SEL2 to SEL4, and the data line driving circuit 110 outputs the same data signal as the data signal output in the driving period GS1 to the data signal supply line SL1. Accordingly, the data signal is written in the pixels on the data line DL1 again.

Figure 7:
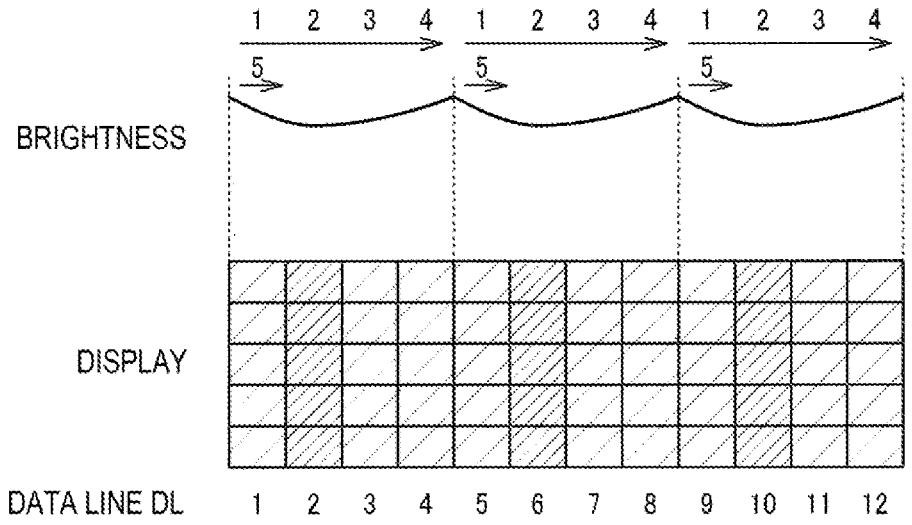
FIG. 7 is a diagram illustrating a relationship between a reduction of a writing error and a display in a first operation example.

FIG. 7 is a diagram illustrating a relationship between a reduction of a writing error and a display in a first operation example. In FIG. 7, numbers "1" to "5" respectively correspond to driving periods GS1 to GS5. Here, it is assumed that data signals having the same target voltage are written in all of the pixels.

As illustrated in FIG. 6, rewriting of the data signal in the data line DL1 is performed in the driving period GS5. At this stage of operation, the data signals are already written in the data lines DL2 to DL4 and hence, the leakage current is approximately zero in the same manner as the leakage current in the driving period GS4. Accordingly, the data lines DL1, DL4 are substantially equal to each other in brightness, and the data lines DL2, DL3 is slightly lower than the data lines DL1, DL4 in brightness. Compared to the configuration illustrated in FIG. 5, there is substantially no difference in brightness at the boundary of the blocks driven by demultiplex driving and hence, display irregularities are minimally visually recognized so that the display quality is enhanced.

Figure 8:
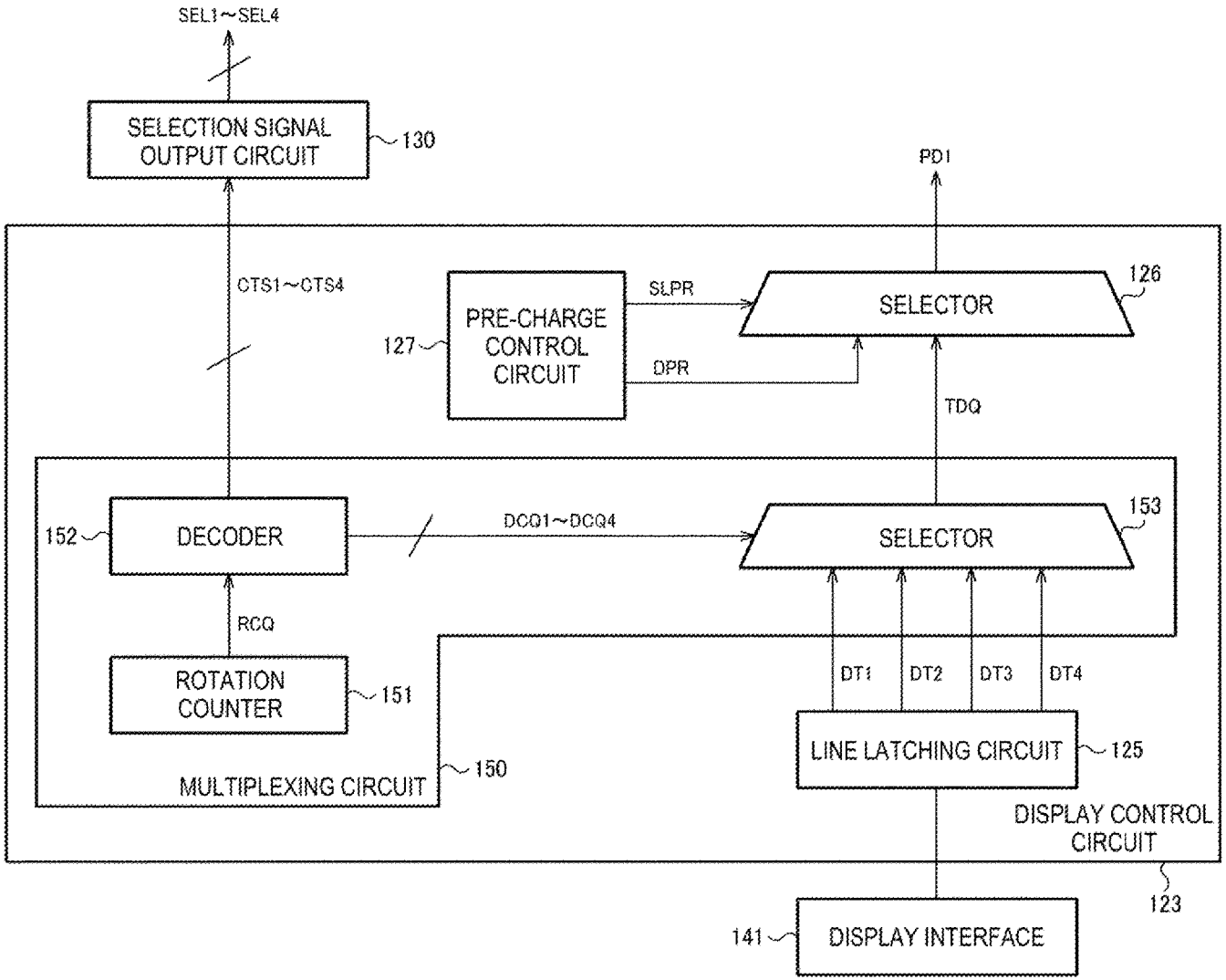
FIG. 8 is a first detailed configuration example of a display control circuit.

FIG. 8 illustrates a first detailed configuration example of the display control circuit 123 configured to control the above-mentioned operations. The display control circuit 123 includes a line latching circuit 125, a selector 126, a pre-charge control circuit 127, and a multiplexing circuit 150. Here, although the description is made by taking the control relating to the display data PD1 as an example, similar processing is performed on each of the display data PD1 to PDp.

In the line latching circuit 125, display data is input from the display interface 141, and the line latching circuit 125 stores the display data for one scanning line. Each of the pixel data DT1 to DT4 is data for one pixel, and indicates a gradation value to be written in the one pixel. To be more specific, the pixel data DT1 indicates a gradation value to be written in the pixels on the data line DL1. In the same manner, the pixel data DT2 to DT4 indicate gradation values to be written in the pixels on the data lines DL2 to DL4 respectively.

The multiplexing circuit 150 is configured to perform multiplexing processing of the pixel data DT1 to DT4, and timing control of the selection signals SEL1 to SEL4. The multiplexing circuit 150 includes a rotation counter 151, a decoder 152, and a selector 153.

The rotation counter 151 is configured to output a count value RCQ for determining the driving sequence of the data lines DL1 to DL4. The rotation counter 151 is configured to output one count value RCQ in each driving period of the driving periods GS1 to GS5.

The decoder 152 determines the driving sequence of the rotation by decoding the count value RCQ. That is, the rotation of the driving sequence is performed by changing the correspondence between the count value RCQ and the driving sequence for each horizontal scanning period.

To be more specific, the decoder 152 activates the selection control signal corresponding to the count value RCQ among the selection control signals CTS1 to CTS4, and to deactivate other selection control signals. The selection signal output circuit 130 is configured to output the selection signals SEL1 to SEL4 by buffering the selection control signals CTS1 to CTS4. For example, when the selection control signal CTS1 is active, the selection signal output circuit 130 outputs an active selection signal SEM.

Further, the decoder 152 is configured to activate a selector control signal corresponding to the count value RCQ among selector control signals DCQ1 to DCQ4, and to deactivate other selector control signals. The selector 153 is configured to select pixel data corresponding to the active selector control signal from among the pixel data DT1 to DT4. For example, when the selector control signal DCQ1 is active, the selector 153 selects the pixel data DT1. The selector 153 outputs the selected pixel data as output data DTQ.

The pre-charge control circuit 127 is configured to perform switching between the pre-charge period TPR and the driving periods GS1 to GS5, and control of the pre-charge voltage. To be more specific, the pre-charge control circuit 127 is configured to output a pre-charge selection signal SLPR that is active in the pre-charge period TPR and is inactive in the driving periods GS1 to GS5. Further, the pre-charge control circuit 127 is configured to output pre-charge data DPR indicating a gradation value of the pre-charge voltage. When the pre-charge selection signal SLPR is active, the selector 126 selects the pre-charge data DPR and, when the pre-charge selection signal SLPR is inactive, the selector 126 selects the output data DTQ of the selector 153. The selector 126 outputs the selected data as the display data PD1.

FIG. 9 illustrates operation examples of the multiplexing circuit 150. In FIG. 9, a diagram on an upper side illustrates an operation example of the multiplexing circuit 150 in a case where rotation is not taken into account, and a diagram on a lower side illustrates an operation example of the multiplexing circuit 150 in a case where the rotation is taken into account.

As illustrated in the upper diagram, the rotation counter 151 is configured to output a count value of two bits. To be more specific, the rotation counter 151 is configured to output count values 00, 01, 10, 11, and 00 in the driving periods GS1, GS2, GS3, GS4, and GS5 respectively. When the count value is 00, 01, 10, and 11, the decoder 152 activates the selection signals SEL1, SEL2, SEL3, and SEL4. In the driving period GS5, the count value is 00 and hence, the selection signal SEL1 is activated. That is, the selection signal SEL1 is activated in the driving periods GS1 and GS5 in common, and the data signal is written in the pixels on the data line DL1. Here, it is sufficient that the number of bits of the count value is set to a number of bits corresponding to the number of times n of demultiplexing. For example, when the number of times n of demultiplexing is set to 8 (n=8), the number of bits of the count value is set to 3.

As illustrated in the lower diagram, the rotation counter 151 is configured to output the count values 00, 01, 10, 11, and 00 in the driving periods GS1, GS2, GS3, GS4, and GS5 respectively. When the count value is 00, 01, 10, and 11, the decoder 152 activates the selection signals SEL3, SEL4, SEL1, and SEL2. In the driving period GS5, the count value is 00 and hence, the selection signal SEL3 is activated. That is, the selection signal SEL3 is activated in the driving periods GS1 and GS5 in common, and the data signal is written in the pixels on the data line DL3. The lower diagram differs from the upper diagram in correspondence between the count value and the selection signal, and the correspondence is changed for each horizontal scanning period and hence, the driving sequence of the rotation is controlled.

In the above-mentioned present embodiment, the circuit device 100 is configured to drive the electro-optical panel 200. The electro-optical panel 200 includes the switching circuit 210 provided between the first to fourth data lines DL1 to DL4 and the data signal supply line SL1. The circuit device 100 includes the selection signal output circuit 130 and the data line driving circuit 110. The selection signal output circuit 130 is configured to output, to the switching circuit 210, the first to fourth selection signals SEL1 to SEL4 for controlling electrically connectings between the first to fourth data lines DL1 to DL4 and the data signal supply line SL1 based on the first to fourth driving sequences of the demultiplex driving. The data line driving circuit 110 is configured to output first to fourth data signals corresponding to the first to fourth data lines DL1 to DL4 to the data signal supply line SL1 in the order of the first to fourth driving sequences. Symbol i is an integer equal to or greater than 1 and equal to or less than n. In the first driving sequence, the selection signal output circuit 130 activates an i-th selection signal SELi, and the data line driving circuit 110 outputs an i-th data signal to an i-th data line DLi. At this stage of operation, after the first to fourth driving sequences, the rewriting operation in which the selection signal output circuit 130 activates the i-th selection signal SELi, and the data line driving circuit 110 outputs the i-th data signal to the i-th data line DLi is performed.

According to the present embodiment, after the normal demultiplex driving is performed in the first to fourth driving sequences, the i-th data signal is rewritten in the i-th data line DLi driven in the first driving sequence. As described above, although the writing error of the i-th data signal that is written in the i-th data line DLi in the first driving sequence is largest, by rewriting the i-th data signal in the i-th data line DLi, the writing error of the i-th data signal is reduced. Accordingly, display irregularities attributed to the writing error is reduced. Further, it is possible to decrease the number of driving amplifiers for lowering the power consumption or to increase the number of times of demultiplexing for the purpose of increasing the number of pixels of the electro-optical panel.

Here, the first to fourth driving sequences mean the order in which the data lines DL1 to DL4 are driven in the driving periods GS1 to GS4. When the rotation is not performed, the data lines DL1, DL2, DL3, and DL4 are driven in this order. When the rotation is performed, any one of the data lines DL1 to DL4 is arbitrarily driven in each driving period, and each data line is driven once. In FIG. 6 and in the upper diagram of FIG. 9, the i-th data line and the i-th selection signal are the first data line DL1 and the first selection signal SEL1, and in the lower diagram of FIG. 9, the i-th data line and the i-th selection signal are the third data line DL3 and the third selection signal SEL3. In FIG. 6 and FIG. 9, "after the first to fourth driving sequences" means the driving period GS5, that is, the fifth driving sequence. However, in a case where the rewriting is performed on two data lines as described later, "after the first to fourth driving sequences" may be the driving period GS6, that is, the sixth driving sequence. Here, in the above-mentioned embodiment, the expression of "first to fourth" may be paraphrased as "first to n-th". Symbol n is an integer equal to or greater than 3.

In the present embodiment, in the pre-charge period TPR before the first to fourth driving sequences, the selection signal output circuit 130 activates the first to fourth selection signals SEL1 to SEL4, and the data line driving circuit 110 outputs the pre-charge voltage to the first to fourth data lines DL1 to DL4.

According to the present embodiment, while the data signal is written in the first to fourth data lines one by one in the first to fourth driving sequences, the pre-charge voltage is held on the data line in which the data signal is not written. Accordingly, due to the difference in voltage between the data signal of the data signal supply line SL1 and the pre-charge voltage held on the data line, a leakage current is generated in the switch. As described above, although the writing error of the data signal attributed to the leakage current becomes maximum in the first driving sequence, the writing error is reduced by performing the rewriting operation.

Further, in the present embodiment, the pre-charge voltage is a negative polarity voltage in the polarity inversion driving. The selection signal output circuit 130 and the data line driving circuit 110 are configured to perform the rewriting operation in the positive polarity driving period in the polarity inversion driving.

Accordingly to the present embodiment, due to the difference in voltage between the positive-polarity data signal of the data signal supply line SL1 and the negative-polarity pre-charge voltage held on the data line, a leakage current is generated in the switch. In such a case, the difference in voltage between both ends of the switch is large compared to a case where the data signal has a negative polarity and hence, the leakage current increases. In the present embodiment, by performing the rewriting operation, the writing error is reduced even in the positive-polarity driving period where the leakage current is large.

Here, the rewriting operation may be performed also in the negative-polarity driving period, as described later, the rewriting operation may be performed in the positive polarity driving period and the rewriting operation may not be performed in the negative polarity driving period. In this case, the rewriting operation in the negative polarity driving period may be disabled by enable control described later.

In the present embodiment, the circuit device 100 includes the multiplexing circuit 150. The multiplexing circuit 150 is configured to multiplex the first to fourth pixel data DT1 to DT4 respectively corresponding to the first to fourth data signals in the first to fourth driving sequences respectively and, further, to multiplex the i-th pixel data DTi after the first to fourth driving sequences. The data line driving circuit 110 includes the D/A converter circuit DA1 configured to perform D/A conversion of the output data of the multiplexing circuit 150, and the amplifier circuit AM1 configured to output the output signal of the D/A converter circuit DA1 to the data signal supply line SL1 after buffering or amplifying the output signal of the D/A converter circuit DA1.

According to the present embodiment, the multiplexing circuit 150 further multiplexes the i-th pixel data DTi after the first to fourth driving sequences and hence, the rewriting operation in which the data line driving circuit 110 outputs the i-th data signal to the i-th data line DLi is realized.

Further, in the present embodiment, the relationship $Rin \times (n-1) \times Ileak\ \Delta V$ is established, wherein Rin is the input resistance value of the data signal supply line SL1, Ileak is the leakage current per one data line in the switching circuit 210, and $\Delta V$ is the voltage step per gradation of the first to n-th data signals.

As described above, the leakage current in the first driving sequence, that is, in the driving period GS1, is $(n-1) \times Ileak$, and the voltage drop attributed to flowing of the leakage current through the input resistance is $Rin \times (n-1) \times Ileak$. This voltage drop brings about the writing error attributed to the leakage current. Since the voltage drop is larger than the voltage step $\Delta V$ per gradation, a possibility that such a voltage drop is visually recognized as the display irregularities is increased. In the present embodiment, the writing error is decreased by performing the rewriting operation and hence, a possibility that the display irregularities are visually recognized is reduced.

Figure 10:
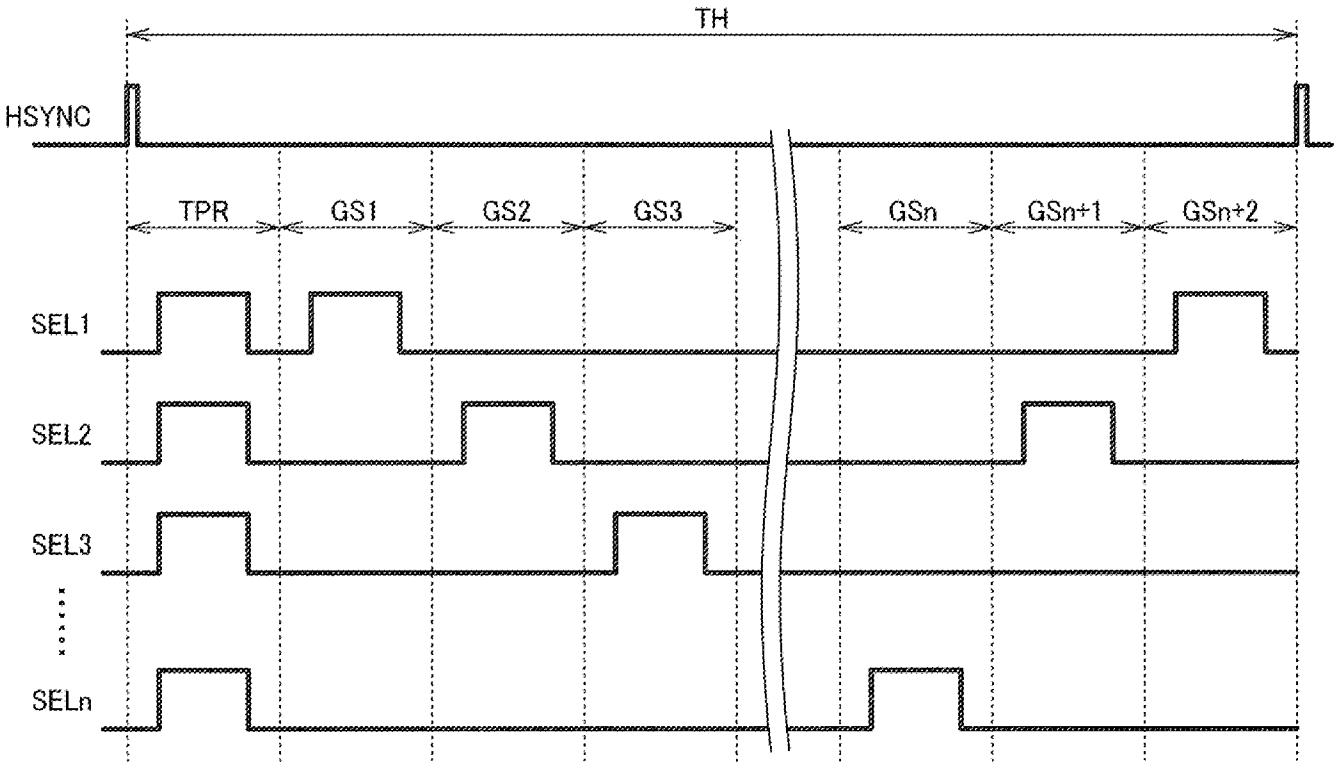
FIG. 10 is a waveform diagram illustrating a second driving method according to the present embodiment.

FIG. 10 is a waveform diagram illustrating a second driving method according to the present embodiment. Here, an example is illustrated where the number of times of demultiplexing is set to an integer n that is equal to or greater than 3, and the rotation is not performed. Further, the description is made by taking an operation of a block of the data signal supply line SL1 and the data lines DL1 to DL4 as an example. However, substantially the same operation is performed also in other blocks.

In the present embodiment, n+2 pieces of driving periods are provided with respect to the number of times n of demultiplexing. That is, the horizontal scanning period TH is divided into a pre-charge period TPR and driving periods GS1 to GSn+2. An operation performed in the pre-charge period TPR is substantially equal to the operation performed in the pre-charge period in FIG. 6. Further, the operations performed in the driving periods GS1 to GSn are also substantially equal to the operations performed in the driving periods GS1 to GS4 in FIG. 6, and in the operations performed in the driving periods GS1 to GSn, the number of times of demultiplexing is merely set to n.

In the driving period GSn+1, the selection signal output circuit 130 outputs a high-level selection signal SEL2 and low-level selection signals SEL1, and SEL3 to SELn, and the data line driving circuit 110 outputs the same data signal as the data signal output in the driving period GS2 to the data signal supply line SL1. With such an operation, the data signal is written in the pixels on the data line DL2 again.

In the driving period GSn+2, the selection signal output circuit 130 outputs a high-level selection signal SEL1 and low-level selection signals SEL2 to SELn, and the data line driving circuit 110 outputs the same data signal as the data signal output in the driving period GS1 to the data signal supply line SL1. Accordingly, the data signal is written in the pixels on the data line DL1 again.

In the present embodiment, in the driving periods GS1, GS2, the data lines DL1 and DL2 are selected in this order, and in the driving periods GSn+1, GSn+2, the data lines DL2 and DL1 are selected in this order. That is, the driving sequence when the data lines DL1 and DL2 are firstly driven and the driving sequence in rewriting are performed in reverse order.

Figure 11:
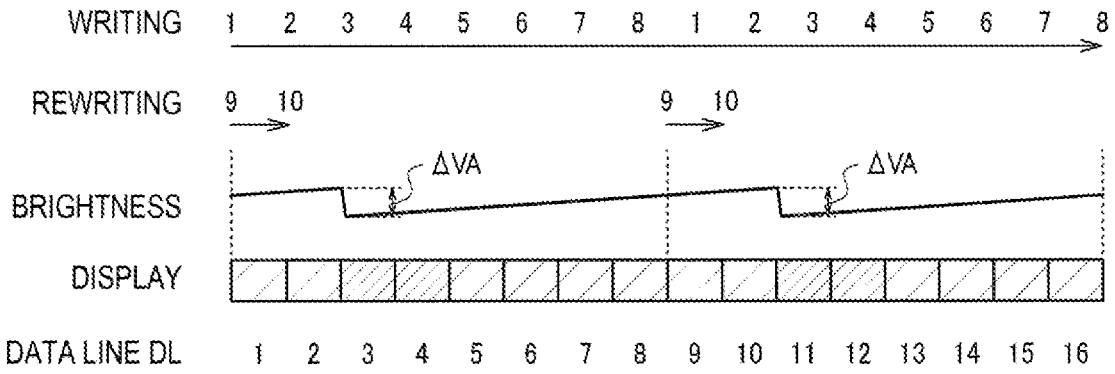
FIG. 11 is a diagram illustrating a relationship between a reduction of a writing error and a display in a second operation example.
Figure 12:
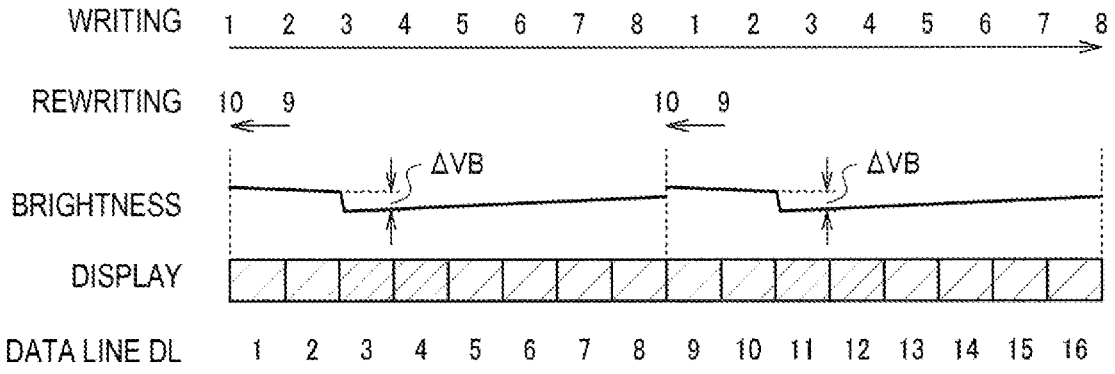
FIG. 12 is a diagram illustrating a relationship between a reduction of a writing error and the display in the second operation example.

FIG. 11 and FIG. 12 are diagrams illustrating a relationship between a reduction of a writing error and a display in the second operation example. Here, it is assumed that the number of times n of demultiplexing is set to 8 (n=8), and data signals having the same target voltage are written in all of the pixels. In FIG. 11 and FIG. 12, numbers "1" to "10" respectively correspond to driving periods GS1 to GS10.

FIG. 11 illustrates a case where the driving sequence in rewriting is not reversed, that is, a case where the data lines DL1, DL2 are driven in this order in the driving periods GS9, GS10. An effect of the leakage current, at the time of writing, on the writing error attributed to the leakage current has been described. However, the leakage current affects the writing error even after the switch is turned off. That is, the data signal is held in the data line by turning off the switch. However, the data signal held in the data line is slightly lowered due to the leakage current of the switch, and such lowering of the data signal brings about the writing error. The shorter a time elapsed after the switch is turned off, the smaller the error becomes. That is, the data signal written in the data line DL1 in the driving period GS9 is slightly lower than the data signal written in the data line DL2 in the driving period GS10 succeeding to the driving period GS9. In this case, assume the difference in brightness between the pixels on the data line DT2 and the pixels on the data line DT3 as ΔVA.

FIG. 12 illustrates a case where the driving sequence in rewriting is reversed, that is, a case where the data lines DL2, DL1 are driven in this order in the driving periods GS9, GS10. As described above, the shorter an elapsed time after the switch is turned off, the smaller the error becomes and hence, the data signal written in the data line DL2 in the driving period GS9 is slightly lower than the data signal written in the data line DL1 in the driving period GS10 succeeding to the driving period GS9. Accordingly, the difference in brightness ΔVB between the pixels on the data line DT2 and the pixels on the data line DT3 in FIG. 12 is less than the difference in brightness ΔVA in FIG. 11. The smaller the difference in brightness between pixels disposed adjacent to each other, the lower the possibility that the difference in brightness is visually recognized becomes. Accordingly, it is understood that, by reversing the driving sequence in the rewriting operation, the possibility that the difference in brightness is visually recognized is lowered.

In the above-described embodiment, when symbol j is an integer equal to or greater than 1 and equal to or less than to n and symbol j is not equal to symbol i (j≠i), in the second driving sequence, the selection signal output circuit 130 activates a j-th selection signal SELj, and the data line driving circuit 110 writes the j-th data signal in a j-th data line DLj. After the first to n-th driving sequences, a rewriting operation in which the selection signal output circuit 130 activates the j-th selection signal SELj, and the data line driving circuit 110 outputs the j-th data signal to the j-th data line DLj is performed.

According to the present embodiment, after the normal demultiplex driving is performed in the first to n-th driving sequences, the j-th data signal is rewritten in the j-th data line DLj driven in the second driving sequence. Although the writing error of the j-th data signal that is written in the j-th data line DLj in the second driving sequence is the second largest, by rewriting the j-th data signal in the j-th data line DLi, the writing error of the j-th data signal is reduced. Accordingly, display irregularities attributed to the writing error are further reduced.

In the present embodiment, the rewriting operation includes a rewriting operation in an n+1-th driving sequence and a rewriting operation in an n+2-th driving sequence after the first to n-th driving sequences. In the n+1-th driving sequence, the selection signal output circuit 130 activates the j-th selection signal SELj, and the data line driving circuit 110 rewrites the j-th data signal in the j-th data line DLj. In the n+2-th driving sequence, the selection signal output circuit 130 activates the i-th selection signal SELi, and the data line driving circuit 110 rewrites the i-th data signal in the i-th data line DLi.

According to the present embodiment, the rewriting is performed on two data lines driven in the first driving sequence and the second driving sequence. At this stage of operation, in the n+1-th driving sequence and the n+2-th driving sequence, rewriting in the data line is performed in reverse order from the first driving sequence and the second driving sequence. That is, rewriting in the i-th data line DLi driven in the first driving sequence is finally performed. Accordingly, as described with reference to FIG. 11 and FIG. 12, compared to a case where the rewriting is performed not in reverse order, the difference in brightness caused by the writing error attributed to the leakage current becomes smaller, and the possibility that the display irregularities are visually recognized is reduced.

Here, in FIG. 10 and FIG. 12, the j-th data line, the j-th selection signal, the i-th data line, and the i-th selection signal are the second data line DL2, the second selection signal SEL2, the first data line DL1, and the first selection signal SEL1 respectively. The n+1-th driving sequence and the n+2-th driving sequence respectively correspond to the driving period GSn+1 and the drive period GSn+2 in FIG. 10, and in the case where n is set to 8 (n=8) illustrated in FIG. 12, the n+1-th driving sequence and the n+2-th driving sequence respectively correspond to the driving periods GS9 and GS10.

Figure 13:
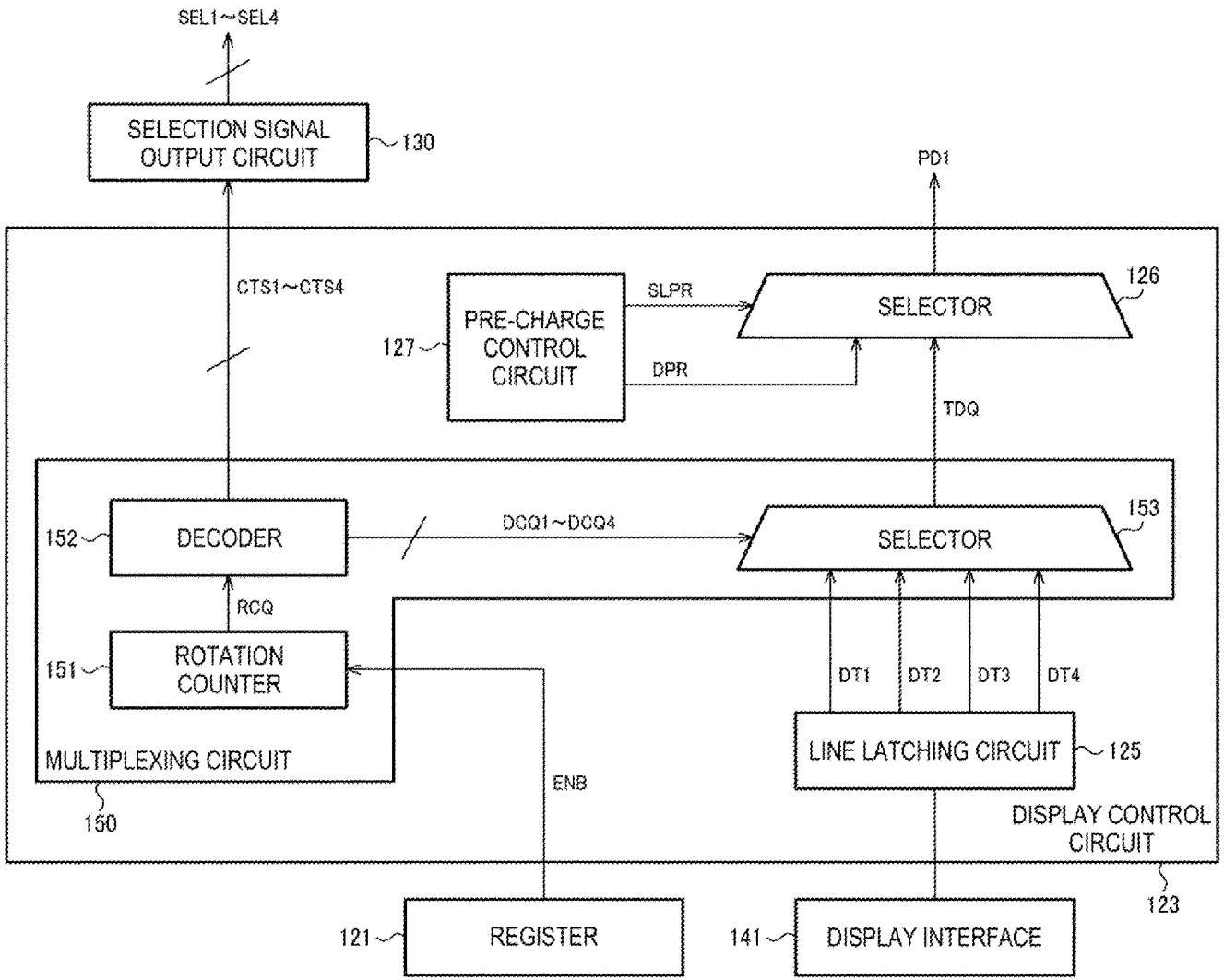
FIG. 13 is a second detailed configuration example of the display control circuit.

FIG. 13 is a second detailed configuration example of the display control circuit 123. In the second detailed configuration example, an enable signal ENB is input from the register 121 to the rotation counter 151. Here, the description is made with respect to only a portion that makes the second detailed configuration example different from the first detailed configuration example in FIG. 8, and the description of portions substantially equal to the corresponding portions of the first detailed configuration example is omitted when appropriate.

The enable signal ENB is a signal for enabling or disabling the rewriting operation. That is, the display control circuit 123 performs a rewriting operation when the enable signal ENB is active, and does not perform the rewriting operation when the enable signal ENB is inactive.

To be more specific, when the enable signal ENB is active, the rotation counter 151 outputs count values RCQ respectively corresponding to the driving periods GS1 to GSn+1 or the driving periods GS1 to GSn+2 in one horizontal scanning period. For example, when n is set to 4 (n=4) and the driving periods GS1 to GS5 are set, as described in FIG. 9, the rotation counter 151 outputs count values 00, 01, 10, 11, and 00 corresponding to the driving periods GS1 to GS5.

When the enable signal ENB is inactive, the rotation counter 151 outputs count values RCQ respectively corresponding to the driving periods GS1 to GSn in one horizontal scanning period. For example, when n is set to 4 (n=4), the rotation counter 151 outputs count values 00, 01, 10, and 11 corresponding to the driving periods GS1 to GS4.

Figure 14:
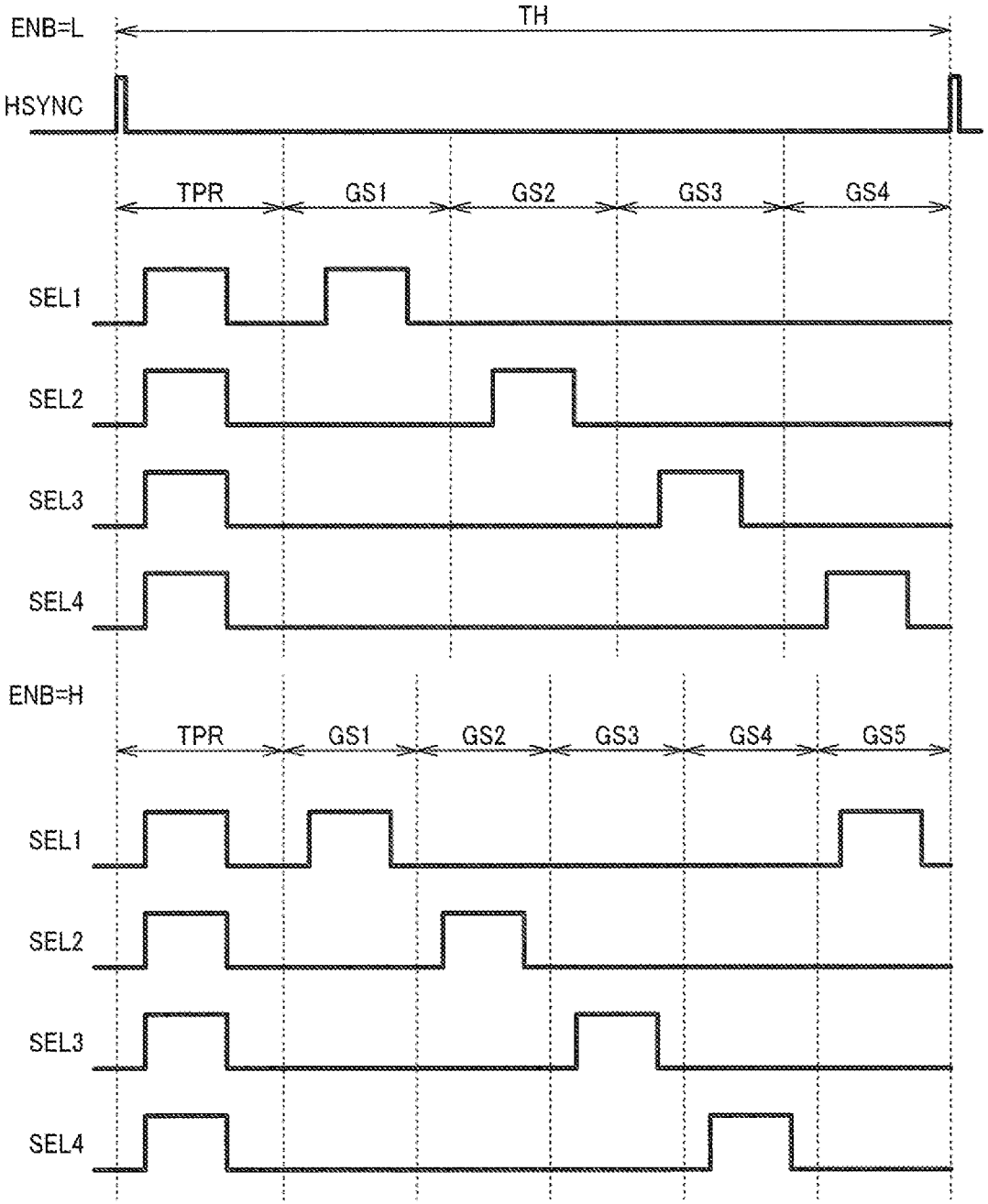
FIG. 14 is a waveform diagram illustrating an operation of the second detailed configuration example.

FIG. 14 is a waveform diagram illustrating an operation of the second detailed configuration example. Here, the number of times n of demultiplexing is set to 4 (n=4), and an active level of the enable signal ENB is set to a high level.

When the enable signal ENB is set as L (ENB=L), that is, when the enable signal ENB is inactive, the horizontal scanning period TH includes the pre-charge period TPR and the driving periods GS1 to GS4, and the driving period GS5 is not included in the horizontal scanning period TH. In the driving periods GS1 to GS4, the selection signal output circuit 130 activates the selection signals SEL1 to SEL4, and the data line driving circuit 110 outputs data signals corresponding to the data lines DL1 to DL4.

When the enable signal ENB is set as H (ENB=H), that is, when the enable signal ENB is active, the horizontal scanning period TH includes the pre-charge period TPR and the driving periods GS1 to GS5. In the driving periods GS1 to GS4, the selection signal output circuit 130 activates the selection signals SEL1 to SEL4, and the data line driving circuit 110 outputs data signals corresponding to the data lines DL1 to DL4.

In the driving period GS5, the selection signal output circuit 130 activates the selection signal SEL1, and the data line driving circuit 110 outputs the same data signals as the data signals output in the driving period GS1.

When the enable signal ENB is set as H (ENB=H), the horizontal scanning period TH may include the pre-charge period TPR and the driving periods GS1 to GS6. Further, in the driving periods GS5, GS6, the selection signal output circuit 130 may activate the selection signals SEL2, SEL1, and the data line driving circuit 110 may output the same data signals as the data signals output in the driving periods GS2, GS1.

In the above-described present embodiment, the circuit device 100 includes the register 121 configured to store the enable signal ENB for the rewriting operation. When the enable signal ENB stored in register 121 indicates enabling of rewriting operation, the rewriting operation is performed by the selection signal output circuit 130 and the data line driving circuit 110.

According to the present embodiment, enabling and disabling of the rewriting operation can be switched. By enabling the rewriting operation, the writing error attributed to the leakage current is reduced. Further, by disabling the rewriting operation, compared to a case where the rewriting operation is enabled, the number of driving periods in demultiplex driving is reduced. With such a configuration, one driving period is elongated and hence, the occurrence of insufficient writing of the data signal is reduced. For example, as described below in FIG. 15, the rewriting operation may be enabled at an intermediate gradation where display irregularities are easily visually recognized, and the rewriting operation may be disabled at a low gradation and at a high gradation.

Further, in the present embodiment, the rewriting operation may be disabled in the negative-polarity driving period in the polarity inversion driving. For example, the display control circuit 123 may generate the enable signal ENB based on a polarity signal for controlling a driving polarity, and may write the enable signal ENB in the register 121. The display control circuit 123 may activate the enable signal ENB when the polarity signal indicates positive polarity driving, and may inactivate the enable signal ENB when the polarity signal indicates negative polarity driving.

As described above, the leakage current in the positive polarity driving period becomes larger than the leakage current in the negative polarity driving period and hence, the writing error in the positive polarity driving period also becomes larger than the writing error in the negative polarity driving period. According to the present embodiment, by enabling the rewriting operation in the positive polarity driving period where the writing error attributed to the leakage current is large, the writing error attributed to the leakage current is reduced. Further, by disabling the rewriting operation in the negative polarity driving period where the writing error attributed to the leakage current is small, one driving period is elongated and hence, the occurrence of insufficient writing of data signal is reduced.

4. Electro-Optical Device, System

Figure 15:
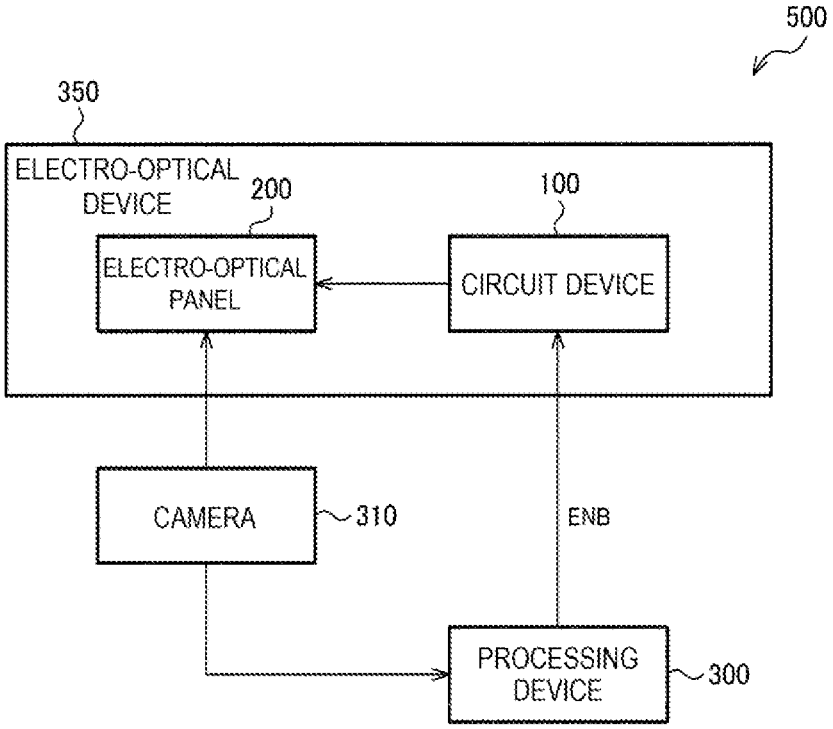
FIG. 15 is a diagram illustrating a configuration example of an electro-optical device, and a configuration example of a system.

FIG. 15 is a diagram illustrating a configuration example of an electro-optical device 350, and a configuration example of a system 500 including the electro-optical device 350. The system 500 includes a processing device 300, a camera 310, and the electro-optical device 350. The electro-optical device 350 includes the circuit device 100 and the electro-optical panel 200. Here, in a case where enabling control using the camera 310 is not performed, the camera 310 may be omitted.

The system 500 is a projector, a personal digital assistant, an information processing device, or the like, for example. However, the system 500 is not limited to these devices, the system 500 may be any device provided that the device performs an image display. The processing device 300 is a CPU, a microcomputer, or the like, and is configured to transmit display data to the circuit device 100. The circuit device 100 allows the electro-optical panel 200 to display an image by driving the electro-optical panel 200 based on input data that the circuit device 100 receives. The camera 310 captures an image displayed on the electro-optical panel 200. Here, in a case where the system 500 is a projector, the image displayed on the electro-optical panel 200 is projected onto a screen by a light source and a projection optical system, and the camera 310 captures the image projected on the screen.

The camera 310 transmits image data to the processing device 300. The processing device 300 analyzes brightness of the image displayed on the electro-optical panel 200 from the received image data. When the brightness of the image is at an intermediate gradation, the processing device 300 writes an active enable signal ENB in the register 121 of the circuit device 100, and when the brightness of the image is at a low gradation or a high gradation, the processing device 300 writes an inactive enable signal ENB in the register 121. With such a configuration, display irregularities are reduced by performing the rewriting operation when the brightness of the image is at an intermediate gradation, and when the brightness of the image is at a low gradation or at a high gradation, the rewriting operation is not performed and hence, a writing time to the pixels is elongated. The display irregularities are easily visually recognized in the case where the brightness is at the intermediate gradation compared to the case where the brightness is at the low gradation or the high gradation. Accordingly, by performing the rewriting operation when the brightness is at the intermediate gradation, the display quality is enhanced.

Here, the enable control is not limited to the above-mentioned control, for example, the processing device 300 may write the enable signal ENB in the register 121 of the circuit device 100, and the circuit device 100 may enable or disable the rewriting operation based on an enable signal ENB set in advance, irrespective of a display gradation.

The circuit device according to the present embodiment described above is configured to drive the electro-optical panel including the switch circuit provided between the first to n-th data lines and the data signal supply line. Symbol n is an integer equal to or greater than 3. The circuit device includes: the selection signal output circuit configured to output the first to n-th selection signals for controlling the electrically connecting between the first to n-th data lines and the data signal supply line to the switching circuit based on the first to n-th driving sequences in demultiplex driving, and the data line driving circuit configured to output the first to n-th data signals corresponding to the first to n-th data lines to the data signal supply line in order of the first to n-th driving sequences. In the first driving sequence among the first to n-th driving sequences, the selection signal output circuit activates the i-th selection signal among the first to n-th selection signals, and the data line driving circuit outputs the i-th data signal among the first to n-th data signals to the i-th data line among the first to n-th data lines. Symbol i is an integer equal to or greater than 1 and equal to or less than n. At this stage of operation, after the first to n-th driving sequences, the rewriting operation in which the selection signal output circuit activates the i-th selection signal, and the data line driving circuit outputs the i-th data signal to the i-th data line is performed.

According to the present embodiment, after the normal demultiplex driving is performed in the first to n-th driving sequences, the i-th data signal is rewritten in the i-th data line driven in the first driving sequence. Although the writing error of the i-th data signal that is written in the i-th data line in the first driving sequence is largest, by rewriting the i-th data signal in the i-th data line, the writing error of the i-th data signal is reduced. Accordingly, display irregularities attributed to the writing error is reduced. Further, it is possible to decrease the number of driving amplifiers for lowering the power consumption or to increase the number of times of demultiplexing for the purpose of increasing the number of pixels of the electro-optical panel.

Further, in the present embodiment, in the second driving sequence among the first to n-th driving sequences, the selection signal output circuit may activate the i-th selection signal among the first to n-th selection signals, and the data line driving circuit may output the j-th data signal among the first to n-th data signals to the j-th data line among the first to n-th data lines. Symbol j is an integer equal to or greater than 1 and equal to or less than n, and j is not equal to i ($j \neq i$). At this stage of operation, after the first to n-th driving sequences, the rewriting operation in which the selection signal output circuit activates the j-th selection signal, and the data line driving circuit outputs the j-th data signal to the j-th data line may be performed.

According to the present embodiment, after the normal demultiplex driving is performed in the first to n-th driving sequences, the j-th data signal is rewritten in the j-th data line driven in the second driving sequence. Although the writing error of the j-th data signal that is written in the j-th data line in the second driving sequence is the second largest, by rewriting the j-th data signal in the j-th data line, the writing error of the j-th data signal is reduced. Accordingly, display irregularities attributed to the writing error are further reduced.

In the present embodiment, the rewriting operation may include the rewriting operation in the n+1-th driving sequence and the rewriting operation in the n+2-th driving sequence after the first to n-th driving sequences. In the n+1-th driving sequence, the selection signal output circuit may activate the j-th selection signal, and the data line driving circuit may rewrite the j-th data signal in the j-th data line. In the n+2-th driving sequence, the selection signal output circuit may activate the i-th selection signal, and the data line driving circuit may rewrite the i-th data signal in the i-th data line.

According to the present embodiment, the rewriting is performed on two data lines driven in the first driving sequence and the second driving sequence. At this stage of operation, in the n+1-th driving sequence and the n+2-th driving sequence, rewriting on the data line is performed in reverse order from the first driving sequence and the second driving sequence. That is, rewriting in the i-th data line driven in the first driving sequence is finally performed. Accordingly, compared to a case where the rewriting is performed not in reverse order, the difference in brightness caused by the writing error attributed to the leakage current becomes smaller, and the possibility that the display irregularities are visually recognized is reduced.

In the present embodiment, in the pre-charge period before the first to n-th driving sequences, the selection signal output circuit may activate the first to n-th selection signals, and the data line driving circuit may output the pre-charge voltage to the first to n-th data lines.

According to the present embodiment, while the data signal is written in the first to n-th data lines one by one in the first to n-th driving sequences, the pre-charge voltage is held on the data line in which the data signal is not written. Accordingly, due to the difference in voltage between the data signal of the data signal supply line and the pre-charge voltage held on the data line, a leakage current is generated in the switch. Although the writing error of the data signal attributed to the leakage current becomes maximum in the first driving sequence, the writing error is reduced by performing the rewriting operation.

Further, in the present embodiment, the pre-charge voltage may be a negative polarity voltage in the polarity inversion driving. The selection signal output circuit and the data line driving circuit may be configured to perform the rewriting operation in the positive polarity driving period in the polarity inversion driving.

Accordingly to the present embodiment, due to the difference in voltage between the positive-polarity data signal of the data signal supply line and the negative-polarity pre-charge voltage held on the data line, a leakage current is generated in the switch. In such a case, the difference in voltage between both ends of the switch is large compared to a case where the data signal has a negative polarity and hence, the leakage current increases. In the present embodiment, by performing the rewriting operation, the writing error is reduced even in the positive-polarity driving period where the leakage current is large.

Further, in the present embodiment, the rewriting operation may be disabled in the negative-polarity driving period in the polarity inversion driving.

The leakage current in the positive polarity driving period becomes larger than the leakage current in the negative polarity driving period and hence, the writing error in the positive polarity driving period also becomes larger than the writing error in the negative polarity driving period. According to the present embodiment, by enabling the rewriting operation in the positive polarity driving period where the writing error attributed to the leakage current is large, the writing error attributed to the leakage current is reduced. Further, by disabling the rewriting operation in the negative polarity driving period where the writing error attributed to the leakage current is small, one driving period is elongated and hence, the occurrence of insufficient writing of data signal is reduced.

Further, in the present embodiment, the circuit device may include the register configured to store the enable signal for the rewriting operation. When the enable signal stored in register indicates enabling of rewriting operation, the rewriting operation may be performed by the selection signal output circuit and the data line driving circuit.

According to the present embodiment, enabling and disabling of the rewriting operation can be switched. By enabling the rewriting operation, the writing error attributed to the leakage current is reduced. Further, by disabling the rewriting operation, compared to a case where the rewriting operation is enabled, the number of driving periods in demultiplex driving is reduced. With such a configuration, one driving period is elongated and hence, the occurrence of insufficient writing of the data signal is reduced.

Further, in the present embodiment, the circuit device may include the multiplexing circuit. The multiplexing circuit may be configured to multiplex the first to n-th pixel data respectively corresponding to the first to n-th data signals in the first to n-th driving sequences respectively and, further, to multiplex the i-th pixel data among the first to n-th pixel data after the first to n-th driving sequences. The data line driving circuit may include the D/A converter circuit configured to perform D/A conversion of the output data of the multiplexing circuit, and the amplifier circuit configured to output the output signal of the D/A converter circuit to the data signal supply line after buffering or amplifying the output signal of the D/A converter circuit.

According to the present embodiment, the multiplexing circuit further multiplexes the i-th pixel data after the first to n-th driving sequences and hence, the rewriting operation in which the data line driving circuit outputs the i-th data signal to the i-th data line is realized.

Further, in the present embodiment, the electro-optical device includes the circuit device and the electro-optical panel according to any one of the descriptions made heretofore.

Further, in the present embodiment, the input resistance value of the data signal supply line may be assumed as Rin, the leakage current per one data line in the switching circuit may be assumed as Ileak, and the voltage step per gradation of the first to n-th data signals may be assumed as $\Delta V$. In this case, the relationship $Rin \times (n-1) \times Ileak\ \Delta V$ may be established.

The leakage current in the first driving sequence is $(n-1) \times Ileak$, and the voltage drop attributed to flowing of the leakage current through the input resistance is $Rin \times (n-1) \times Ileak$. This voltage drop brings about the writing error attributed to the leakage current. Since the voltage drop is larger than the voltage step $\Delta V$ per gradation, a possibility that such a voltage drop is visually recognized as the display irregularities is increased. In the present embodiment, the writing error is reduced by performing the rewriting operation and hence, a possibility that the display irregularities are visually recognized is reduced.

Although the present embodiment has been described in detail above, those who are skilled in the art will easily understand that many modified examples can be made without substantially departing from novel items and effects of the present disclosure. All such modified examples are thus included in the scope of the disclosure. For example, terms in the descriptions or drawings given even once along with different terms having identical or broader meanings can be replaced with those different terms in all parts of the descriptions or drawings. All combinations of the embodiment and modified examples are also included within the scope of the disclosure. Further, the configurations, manner of operations, and the like of the circuit device, the electro-optical panel, the electro-optical device, the system, and the like are not limited to those described in the embodiment, and various modifications thereof are conceivable.

What is claimed is:

1. A circuit device comprising:

a selection signal output circuit configured to output first to n-th selection signals, for controlling electrically connecting first to n-th data lines of an electro-optical panel and a data signal supply line of the electro-optical panel based on first to n-th driving sequences in demultiplex driving, to a switching circuit disposed between the first to n-th data lines and the data signal supply line, n being an integer equal to or more than 3; and a data line driving circuit configured to output first to n-th data signals corresponding to the first to n-th data lines to the data signal supply line in order of the first to n-th driving sequences, wherein in the first driving sequence among the first to n-th driving sequences, the selection signal output circuit activates an i-th selection signal among the first to n-th selection signals, and the data line driving circuit outputs an i-th data signal among the first to n-th data signals to an i-th data line among the first to n-th data lines, i being an integer not less than 1 and not greater than n, after the first to n-th driving sequences, a rewriting operation in which the selection signal output circuit activates the i-th selection signal, and the data line driving circuit outputs the i-th data signal to the i-th data line is performed, in the second driving sequence among the first to n-th driving sequences, the selection signal output circuit activates a j-th selection signal among the first to n-th selection signals, and the data line driving circuit writes a j-th data signal among the first to n-th data signals in a j-th data line among the first to n-th data lines, j being an integer not less than 1 and not greater than n, j being not equal to i, after the first to n-th driving sequences, the rewriting operation in which the selection signal output circuit activates the j-th selection signal, and the data line driving circuit outputs the j-th data signal to the j-th data line is performed, the rewriting operation includes a rewriting operation in an n+1-th driving sequence and a rewriting operation in an n+2-th driving sequence after the first to n-th driving sequences, and in the n+1-th driving sequence, the selection signal output circuit activates the j-th selection signal, and the data line driving circuit rewrites the j-th data signal in the j-th data line, and in the n+2-th driving sequence, the selection signal output circuit activates the i-th selection signal, and the data line driving circuit rewrites the i-th data signal in the i-th data line.

2. The circuit device according to claim 1, wherein in a pre-charge period before the first to n-th driving sequences, the selection signal output circuit activates the first to n-th selection signals, and the data line driving circuit outputs a pre-charge voltage to the first to n-th data lines.

3. The circuit device according to claim 2, wherein the pre-charge voltage is a negative polarity voltage in polarity inversion driving, and the selection signal output circuit and the data line driving circuit perform the rewriting operation in a positive polarity driving period in the polarity inversion driving.

4. The circuit device according to claim 3, wherein in a negative polarity driving period in the polarity inversion driving, the rewriting operation is disabled.

5. The circuit device according to claim 1, comprising a register configured to store an enable signal for the rewriting operation, and when the enable signal stored in the register indicates enabling of the rewriting operation, the selection signal output circuit and the data line driving circuit perform the rewriting operation.

6. The circuit device according to claim 1, comprising a multiplexing circuit configured to multiplex first to n-th pixel data corresponding to the first to n-th data signals in the first to n-th driving sequences, and to further multiplex an i-th pixel data among the first to n-th pixel data after the first to n-th driving sequences, and the data line driving circuit comprises:

a D/A converter circuit configured to perform D/A conversion of output data of the multiplexing circuit; and an amplifier circuit configured to output an output signal of the D/A converter circuit to the data signal supply line after buffering or amplifying the output signal of the D/A converter circuit.

7. An electro-optical device comprising:

the circuit device; and the electro-optical panel according to claim 1.

* * * * *